US008387643B2

(12) United States Patent
Van Aalst

(10) Patent No.: US 8,387,643 B2
(45) Date of Patent: Mar. 5, 2013

(54) SELF-ERECTING TENT

(76) Inventor: Roy Bernardus Johannes Van Aalst, Elst (NL)

( * ) Notice: Subject to any disclaimer, the term of this patent is extended or adjusted under 35 U.S.C. 154(b) by 0 days.

(21) Appl. No.: 13/350,349

(22) Filed: Jan. 13, 2012

(65) Prior Publication Data

US 2012/0160287 A1 Jun. 28, 2012

Related U.S. Application Data

(63) Continuation of application No. 11/993,437, filed as application No. PCT/NL2006/000317 on Jun. 27, 2006, now Pat. No. 8,096,311.

(30) Foreign Application Priority Data

Jun. 29, 2005 (NL) ..... 1029365

(51) Int. Cl.
*E04H 15/40* (2006.01)

(52) U.S. Cl. ..... 135/126; 135/125

(58) Field of Classification Search ..... 135/116, 135/125, 126
See application file for complete search history.

(56) References Cited

U.S. PATENT DOCUMENTS

| | | | |
|---|---|---|---|
| 2,907,056 | A | 10/1959 | Kaplan |
| 4,590,956 | A | 5/1986 | Griesenbeck |
| 4,858,634 | A | 8/1989 | McLeese |
| 5,163,461 | A | 11/1992 | Ivanovich et al. |
| 5,337,772 | A | 8/1994 | Habchi |
| 5,396,917 | A | 3/1995 | Hazinski et al. |
| 5,601,105 | A | 2/1997 | Blen et al. |
| 5,636,478 | A | 6/1997 | Chen |
| 5,809,592 | A | 9/1998 | McAllister |
| 6,672,323 | B2 | 1/2004 | Gupta et al. |
| 7,174,584 | B2 | 2/2007 | Danaher |
| 2008/0190473 | A1 | 8/2008 | Mettavant |

FOREIGN PATENT DOCUMENTS

WO WO 00/43616 A1 7/2000

OTHER PUBLICATIONS

International Search Report for PCT/NL2006/000317 dated Sep. 25, 2006.

*Primary Examiner* — Noah Chandler Hawk
(74) *Attorney, Agent, or Firm* — Leydig, Voit & Mayer, Ltd.

(57) ABSTRACT

A self-erecting tent, provided with at least three resilient frame elements (1, 2, 3) formed into endless loops which stretch a tent covering, with the tent in erected position, while at least two of the frame elements (1, 2) cross adjacent an underside of the tent, at least, with the tent in erected position.

12 Claims, 4 Drawing Sheets

SELF-ERECTING TENT

CROSS-REFERENCE TO RELATED APPLICATION

This application claims the priority benefit of van Aalst, U.S. patent application Ser. No. 11/993,437, filed on Dec. 20, 2007, entitled "A SELF ERECTING TENT," the contents of which are expressly incorporated herein by reference in their entirety, including any references therein.

FIELD OF THE INVENTION

The invention relates to a self-erecting tent, provided with at least three resilient frame elements formed into endless loops which stretch a tent covering, when the tent is in an erected position.

BACKGROUND

Such a tent is known per se from U.S. Pat. No. 4,858,634. This known tent is provided with an elliptical, resilient support part which, during use, extends completely on an underground. The known tent is further provided with one or two saddle-shaped, resilient support parts for stretching a tent covering. During use, the supports parts can be folded into a circular disc for storing the tent. The support parts are interconnected at four points. An advantage of such a tent is that it can be erected relatively rapidly and be folded together into a relatively small storage volume. Moreover, in the position of use, the tent needs not be coupled to an underground by, for instance, pegs and guy ropes.

A drawback of the known tent is that in folded-out condition of the tent, the covering is relatively limp. Furthermore, the known tent is relatively little durable, and relatively expensive with regard to production. Further, the covering is relatively irregularly loaded by the support parts, which can lead to damage to the covering.

U.S. Pat. No. 5,601,105 describes a different tent design, with three loops, a lower front panel with a door opening, an upper front panel, a central panel and a rear panel, with the three loops criss-crossing adjacent the underside of the tent. A drawback of this tent is that it offers relatively little inside space and that the loops produce different stresses on the tent cloth.

SUMMARY OF THE INVENTION

The present invention contemplates obviating the above-mentioned problems. The object of the invention is, in particular, a relatively simple, preferably relatively inexpensive and durable self-erecting tent, while, in particular, the covering can be kept relatively taut and relatively much inside space can be provided.

To this end, the tent according to the invention is characterized in that a first frame element and a second frame element cross at two positions adjacent the underside of the tent, on either side of the tent, at least with the tent in erected position, while arch parts remote from each other of a third frame element extend at positions between a tent upper side and a tent underside, at least, with the tent in erected position.

It appears that in this manner, a relatively stable, self-erecting tent can be obtained. The tent can be designed to be relatively durable, from relatively few parts and, furthermore in a relatively inexpensive manner.

Further, the frame elements, which cross adjacent the underside of the tent when the tent is brought in a folded-out position of use, can keep the covering of the tent relatively taut. Furthermore, the frame elements can produce a relatively homogenous load on the covering, at least, homogenous or distributed such that overload of the covering can be prevented.

Further, in this manner, a relatively comfortable, large inside space can be obtained with, for instance, sidewalls which, adjacent the head and foot, include relatively large angles with a ground surface of the tent.

It is noted that U.S. Pat. No. 5,163,4161 describes an elaboration of a selferecting tent, which is provided with only one endless continuous steel wire which is twisted into three elliptical loops. This embodiment is little stable and relatively susceptible to breakage, relatively difficult to manufacture and therefore relatively expensive.

BRIEF DESCRIPTION OF THE DRAWINGS

Further elaborations of the invention are described in the subclaims. Presently, the invention will be clarified on the basis of an exemplary embodiment and the drawing. In the drawing;

DETAILED DESCRIPTION OF THE DRAWINGS

FIGS. 1-4 show an exemplary embodiment of a portable lightweight tent 10, with the tent in a folded-out, self-erected position of use. The tent 10 is provided with only three resilient frame elements 1, 2, 3 formed into endless loops. The frame elements 1, 2, 3 are provided with a tent covering 4 such that this covering 4 is stretched by the frame elements, with the tent 10 in the represented folded-out position of use. Preferably, an inside space of the tent 10 can be completely closed off from an environment by the covering 4, at least such that ingress of, for instance, mosquitoes or other objects can be prevented.

The frame elements 1, 2, 3 can each be manufactured in different manners and from different materials, for instance from a suitable, resilient elastic synthetic, fibre-reinforced material, composite, carbon fibre, a suitable metal, alloy and/or the like. In the exemplary embodiment, each frame element 1, 2, 3 is a substantially elliptical or circular element. Each frame element can for instance comprise an endless tube, rod or such element, hollow or not hollow, formed into a loop with a cross section that is, for instance, round or formed otherwise.

The covering 4 of the tent 10 can also be designed in different manners, from different materials, for instance a suitable cloth of textile, plastic and/or the like. The covering 4 may be partly provided with an air transmissive structure, for instance a suitable gauze, mosquito net or the like. Preferably, the covering 4 is provided with a closable entrance, window parts closed off by gauze and/or the like. Entrance parts and/or window parts of the covering 4 may be detachable by means of zippers, Velcro connections and/or the like. Furthermore, the covering may be provided with one of more covering layers, for instance with an inner tent covering and an outer tent covering. An entrance may for instance be located in a longitudinal side and/or upper side of the covering, at a distance from a head H and a foot F.

Furthermore, the frame elements 1, 2, 3 and the covering 4 can be coupled to each other in different manners. For instance, the covering 4 may be provided with suitable passages, loops, recesses, connecting means, hemmed edges and/or the like, or be designed differently, for holding the frame elements 1, 2, 3. The frame elements 1, 2, 3 and the covering can be fixedly or detachably coupled to each other. The frame elements 1, 2, 3 can, for instance, be coupled together only via the covering 4, so that no special connecting means are to be used for coupling these elements 1, 2, 3 together.

The tent 10 may be a baby tent or toddler tent, or a tent suitable for grown ups. The tent 10 can for instance have different sizes.

Figure 2:
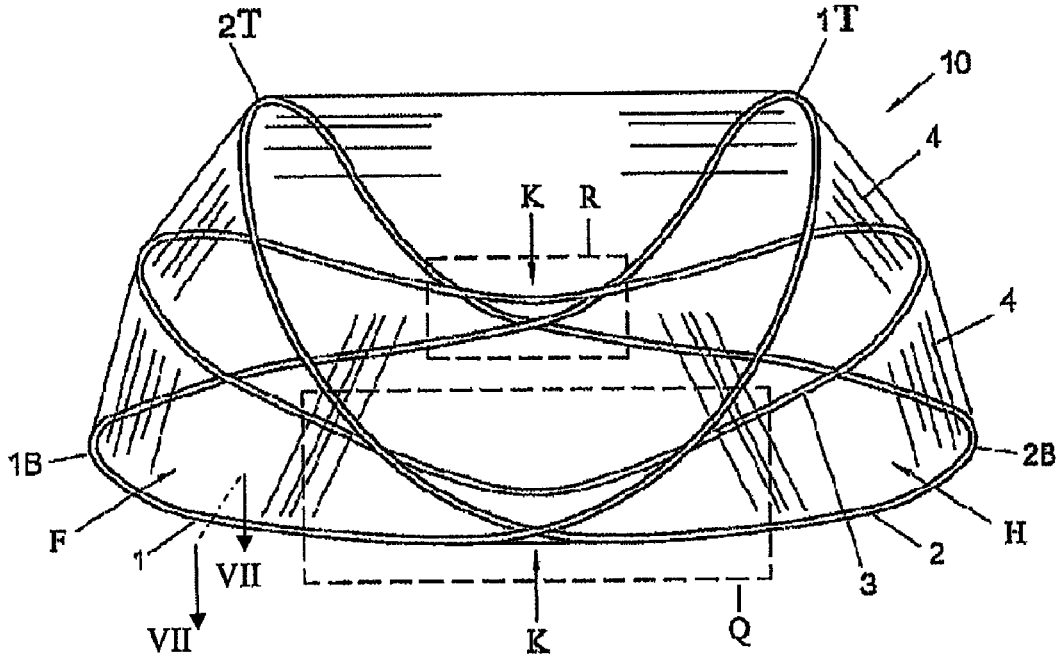
FIG. 2 shows a perspective side view of the exemplary embodiment represented in FIG. 1.
Figure 3:
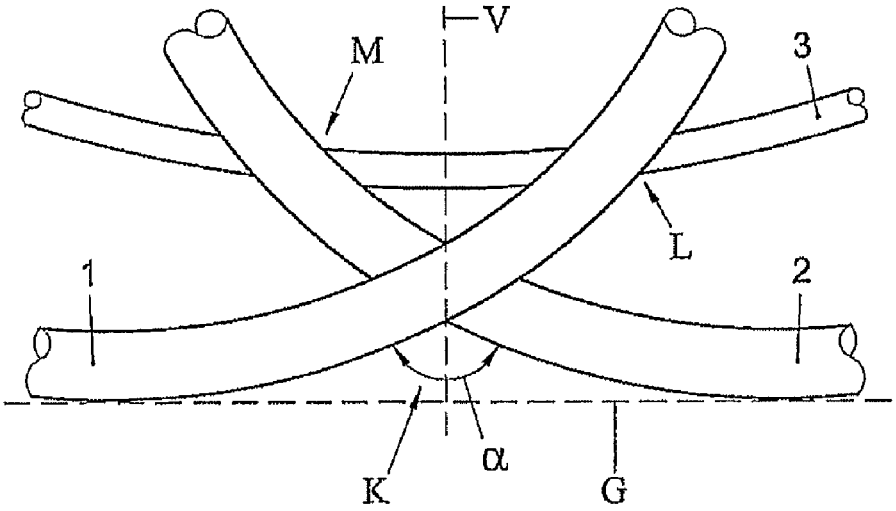
FIG. 3 shows a detail Q of FIG. 2, in side view, while the tent covering is not represented.
Figure 4:
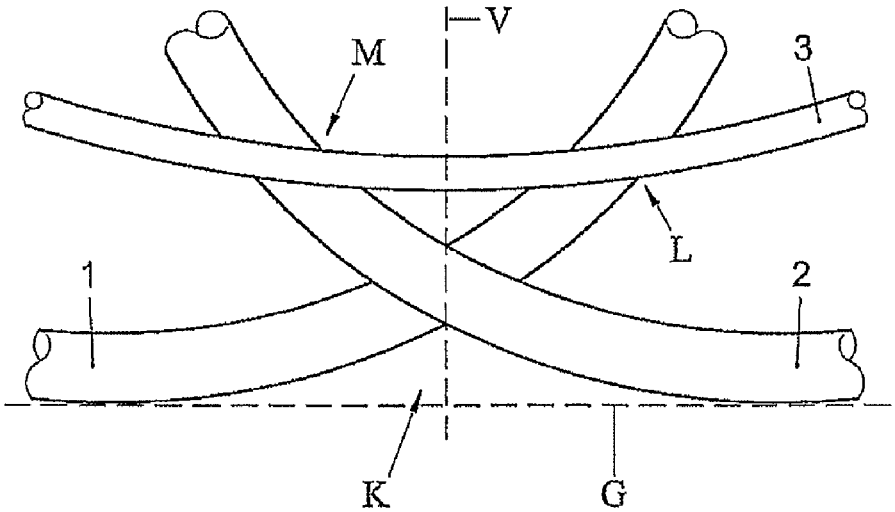
FIG. 4 shows a detail R of FIG. 2, in side view, while the tent covering is not represented.

As is clearly shown in FIGS. 3 and 4, two of the frame elements 1, 2 cross adjacent an underside of the tent 10, at least viewed in a side view of the tent 10. In particular, the tent 10 is provided with a first frame element 1 and a second frame element 2, which cross at two positions adjacent the underside of the tent 10, on either side of the tent 10. In FIGS. 1-4, the crossings are indicated with K. The tent underside bears, during use, on, for instance, and underground indicated by broken line G in FIGS. 3-4. As clearly shown in FIGS. 3-4, the two crossings K are in or adjacent a vertical central transverse plane V of the tent 10, which plane V extends perpendicularly to the longitudinal direction of the tent 10. With the tent in erected position, the crossings K are located at a relatively short distance above the underground G. As it is, the crossings K of the first and second frame element 1, 2 do not touch the underground G (see FIGS. 3 and 4). As shown in FIG. 3, the first and second frame element 1, 2, viewed in side view, can include an angle a with each other at the crossing K mentioned which is smaller than 180°. Furthermore, both the first and the second frame element 1, 2 cross the central transverse plane V obliquely, at least not perpendicularly, viewed in side view.

In the exemplary embodiment, both the first and the second frame element 1, 2 are provided with an upper arch part 1T, 2T respectively, located, with the tent in erected position, at the tent upper side. Furthermore, both the first and the second frame element 1, 2 are provided with a lower arch part 1B, 2B, respectively, located, with the tent in erected position, at the underside of the tent 10. The two lower arch parts 1B, 2B of the first and second frame part 1, 2, face substantially away from each other, and can stretch a bottom B of the tent 10. A roof part T of the tent can be stretched between the two upper arch parts 1T, 2T of the first and second frame part 1, 2. As shown in the Figures, with the tent 10 in the position of use, the first and second frame element 1, 2 are folded out to form substantially bent ellipsoids with substantially the same form. The bent ellipsoids 1, 2 are substantially mirror symmetrical relative to the central transverse plane V mentioned. Furthermore, the tent is substantially mirror symmetrical relative to the central transverse plane V, as clearly follows from the drawing. It appears that in this manner, an equally balanced loading of the covering 4 can be obtained, which increases the durability of the tent.

As further shown in the Figures, the exemplary embodiment is provided with a third frame element 3. Arch parts remote from each other of the third frame element 3 extend at positions between the tent upper side and tent lower side, at least with the tent in erected position.

In particular, the arch parts remote from each other of the third frame element 3 extend at lower positions than the upper arch parts 1T, 2T of the first and second frame element 1, 2, with the tent in a position of use. Moreover, the arch parts remote from each other of the third frame part 3 are then located at higher positions than the lower arch parts 1B, 2B of the first and second frame element 1, 2.

Preferably, these arch parts remote from each other of the third frame element 3 extend, for instance, approximately at half the height of the tent 10, at least at the foot F and head H mentioned. With the tent 10 in the position of use, the third frame element 3 is for instance also folded-out to form a substantially bent ellipsoid, with for instance virtually the same form as that of the first and second element 1, 2 in the respective folded-out position of use.

In this manner, the inside space of the tent 10, in particular the head H and the foot F, can be enlarged in a simple manner, and overload to the covering 4 can be prevented.

In the position of use, the third frame element 3 is for instance somewhat saddle-shaped. The third frame element 3 may extend at a distance from the crossings K between the first and second frame element 1, 2 with the tent in erected position. As shown in FIGS. 3 and 4, the third frame element can cross the central transverse plane V for instance substantially at right angles, and runs, at that location, for instance substantially parallel to the underground G of the tent 10. Furthermore, the third frame element 3 can, for instance, form two crossings L with the first frame element, and two crossings M with the second frame element 2. In an alternative elaboration (not shown), the third frame element 3 may cross the crossings K between the first and second frame element 1, 2 or reach therealong.

Figure 5:
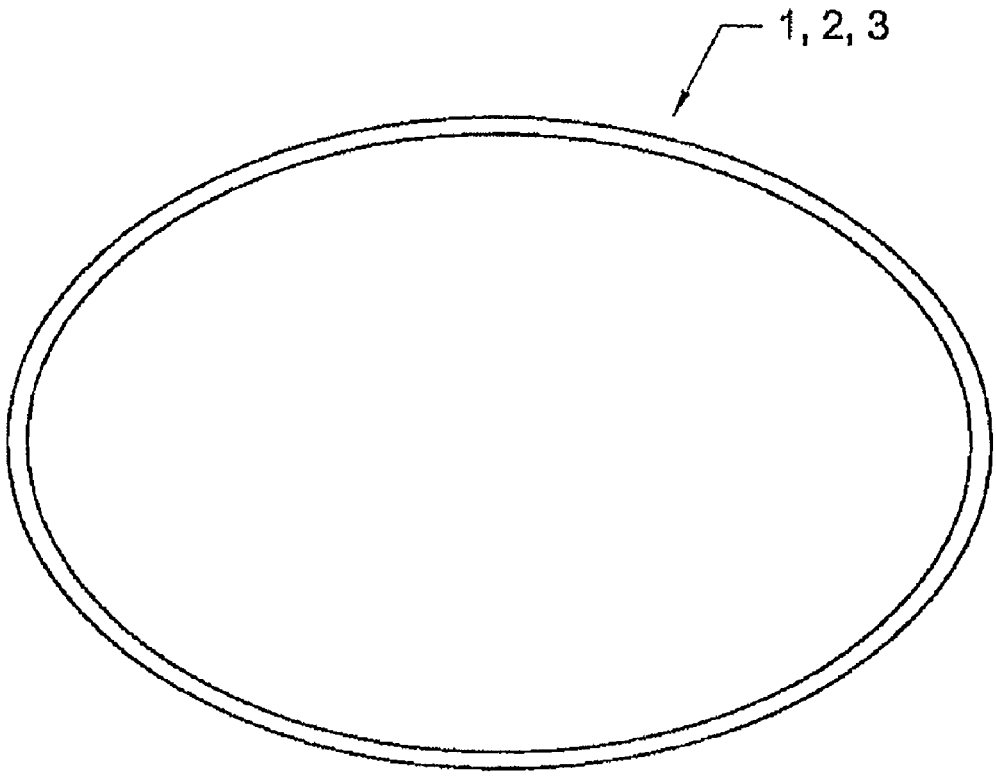
FIG. 5 shows a top plan view of a frame element of the exemplary embodiment represented in FIGS. 1-4, in a relaxed position.
Figure 6:
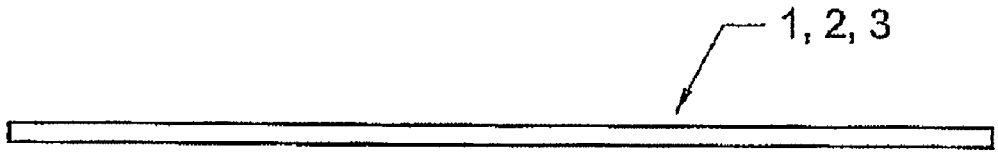
FIG. 6 shows a side view of FIG. 5.

Preferably, the three frame elements 1, 2, 3 are designed such that they can produce a particular spring force on the tent covering 4 with the tent in erected position. It is, for instance, advantageous when the frame elements 1, 2, 3 each independently would bend or relax into a substantially flat elliptical or circular starting position, if the frame elements 1, 2, 3 were not provided with the tent covering 4 and were, for instance, released. Such a flat starting position, in itself elliptical, is represented in FIGS. 4 and 5. It appears that the elliptical starting position is advantageous in particular with a relatively low tent. In the exemplary embodiment, such a relaxation of the frame elements 1, 2, 3 is then counteracted by the tent covering 4, which may lead to the covering being stretched relatively tautly. Here, the three frame elements 1, 2, 3 form springs that can automatically bring the covering 4 to the folded-out position of use, and can keep it at a relatively uniformly distributed tension. The third frame element 3 can then simply effect that, both adjacent the head H and foot F, the tent wall/covering proceeds upwards in a relatively straight manner, or includes only a small angle with a vertical plane, so as to provide more head/foot space in the tent 10. The third frame element 3 further provides additional stability to the tent 10.

Figure 1:
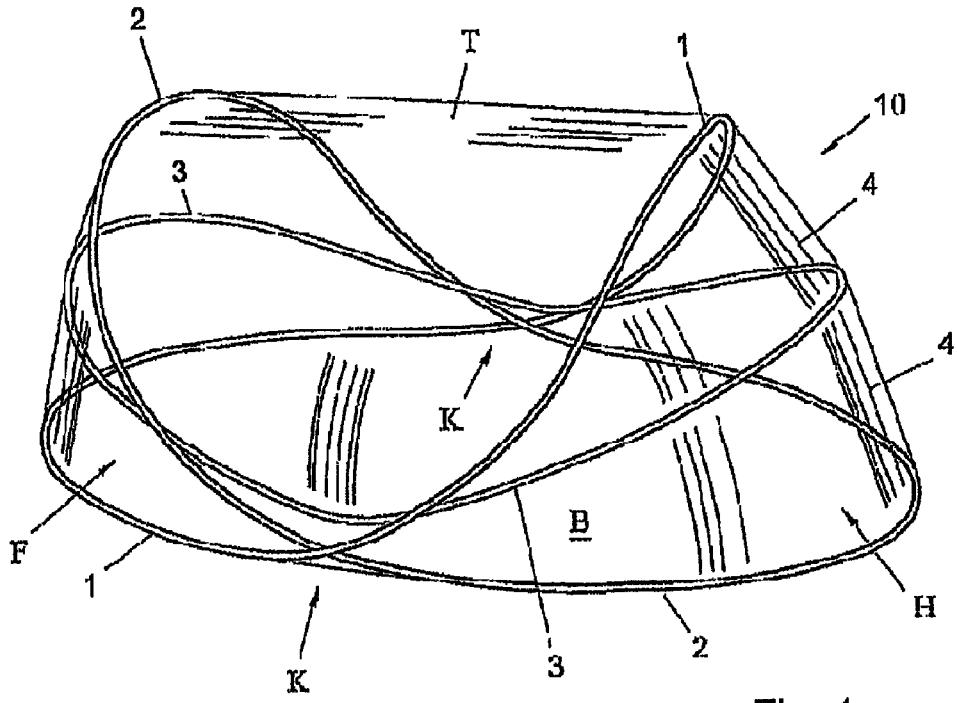
FIG. 1 shows a perspective view of an exemplary embodiment of the invention.
Figure 8:
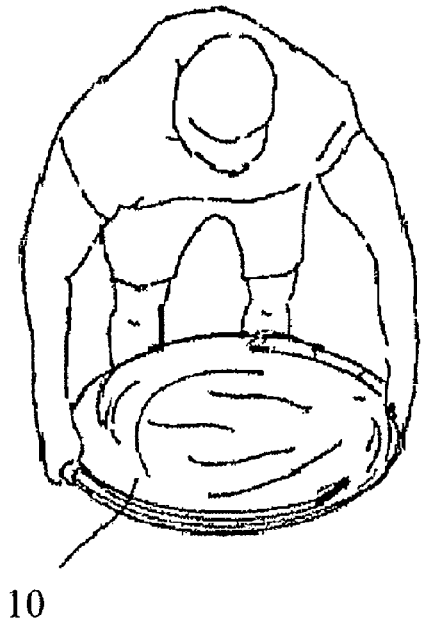
FIG. 8 shows the tent in a stored position that is substantially circular.

The tent can simply be brought from the erected position shown in FIGS. 1 and 2 to a collapsed position, and vice versa. In the collapsed position, as shown in FIG. 8, the tent 10 is preferably substantially circular or disc-shaped. Collapsing the tent 10 may be carried out in a manner corresponding to that as described in FIGS. 8-15 of U.S. Pat. No. 4,858,634, which Figures are understood to be incorporated in the present application by reference. Here, the head H and foot F of the tent 10 are first folded together, while the bottom parts 1B, 2B of the frame elements 1, 2 are moved towards each other. The thus collapsed structure can be rotated through 90° and be placed on an underground to then be collapsed further to form a circular or disc-shaped structure. Thereupon, the collapsed tent can for instance be fixed in that position and/or be stored.

The tent 10 represented in the Figures is relatively stable and durable, and lightweight. Furthermore, the tent 10 can be designed in relatively few parts.

It is self-evident that the invention is not limited to the described exemplary embodiment. Various modifications are possible within the framework of the invention as set forth in the following claims.

Figure 7:
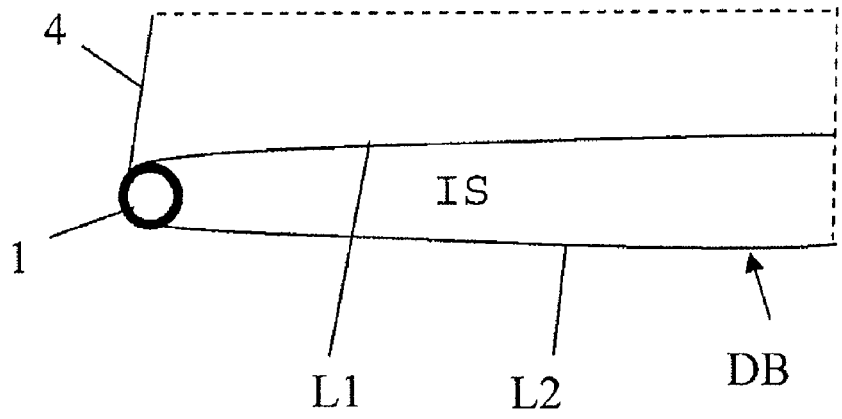
FIG. 7 shows a partial cross-section of the bottom of the exemplary tent in FIG. 1.

For instance, a bottom of the tent can for instance be integrally provided with a mattress, or with a bag or recess in which a mattress can be placed. To this end, the tent can for instance be provided with a double bottom DB, for instance a bottom with two cloth layers L1, L2 provided one on top of the other which can bound a space IS in which a mattress can be included. Such bottom is illustratively depicted in partial cross-section in FIG. 7 which is a cross section of the double bottom DB over line VII-VII of FIG. 2.

The invention claimed is:

1. A tent including:

at least three individual resilient frame elements, integrated with a tent covering, which extend the tent covering when the tent is changed from a collapsed position to an erected position, wherein each of the at least three individual resilient frame elements is a respective endless loop, wherein a first said frame element and a second said frame element of the at least three individual resilient frame elements cross at two positions adjacent an underside of the tent, the two positions being on each of two opposite sides of the tent, at least with the tent in the erected position, while arch parts remote from each other of a third frame element of the three individual resilient frame elements extend at positions between an upper side of the tent and the underside of the tent, at least, with the tent in the erected position, wherein:

both the first frame element and the second frame element each include a top part located, with the tent in the erected position, adjacent the upper side of the tent;

both the first frame element and the second frame element include a lower part located, with the tent in the erected position, adjacent the underside of the tent; and the arch parts remote from each other of the third frame element extend, with the tent in the erected position, at: lower positions than upper arch parts of the first frame element and second frame element, and higher positions than lower arch parts of the first frame element and second frame element; and wherein the tent, when in the erected position, is supported by the first and second frame elements and the tent covering such that the third frame element is suspended above a tent underside, and extends at all points along the third frame element, a non-zero distance from the tent underside.

2. The tent according to claim 1, wherein the third frame element extends at a distance from the crossings between the first frame element and second frame element, with the tent in the erected position.

3. The tent according to claim 2 wherein the third frame element extends fully above a level of the crossings between the first frame element and second frame element, with the tent in the erected position.

4. The tent according to claim 1, wherein each of the at least three individual resilient frame elements is a substantially elliptical element.

5. The tent according to claim 1, wherein the tent can be brought from said erected position to a collapsed position and vice versa, the tent being substantially circular in a collapsed position.

6. The tent according to claim 1, wherein the tent is substantially mirror symmetrical relative to a central transverse plane of the tent.

7. The tent according to claim 1, wherein the tent is provided with a two layer bottom defining a bound space for placing a mattress therein.

8. The tent according to claim 1 wherein the third frame element extends fully above a level of the crossings between the first frame element and second frame element, with the tent in the erected position.

9. The tent according to claim 1 wherein the first frame element and the second frame element provide a primary source of force suspending the tent covering.

10. The tent according to claim 9 wherein the third frame element is suspended above the tent underside by a suspending force provided by the first frame element and second frame element, and applied to the third frame element via the tent covering.

11. The tent according to claim 1 wherein relaxation of the third frame element is counteracted, while the tent is in the erected position, by forces exerted by the tent covering.

12. The tent according to claim 1 wherein the first, second and third frame elements are constrained in their relative partially relaxed positions, while the tent is in the erected position, by the tent covering, thereby avoiding a need for frame coupling elements that are not permanently connected to the tent.

* * * * *